United States Patent [19]

McVey et al.

[11] 4,135,176

[45] Jan. 16, 1979

[54] THERMAL SWITCH AND METHOD OF MAKING

[75] Inventors: John K. McVey, Chicago; Bruce A. Luxon, Bensenville; Larry L. Sharp, Schaumburg, all of Ill.

[73] Assignee: Illinois Tool Works Inc., Chicago, Ill.

[21] Appl. No.: 844,414

[22] Filed: Oct. 21, 1977

[51] Int. Cl.[2] ..... H01H 37/76

[52] U.S. Cl. ..... 337/404; 337/401; 337/407

[58] Field of Search ..... 337/401, 402, 403, 404, 337/405, 406, 407, 408, 409; 29/622, 623

[56] References Cited

U.S. PATENT DOCUMENTS

| | | | |
|---|---|---|---|
| 1,940,176 | 12/1933 | Marshall | 337/405 |
| 2,149,773 | 3/1939 | Huntley | 337/403 |
| 3,913,054 | 10/1975 | Wolfe | 337/362 |
| 3,952,274 | 4/1976 | Plasko | 337/407 |
| 4,016,523 | 4/1977 | Sidor | 337/403 |

*Primary Examiner*—Harold Broome

*Attorney, Agent, or Firm*—Glenn W. Bowen; Robert W. Beart

[57] ABSTRACT

A thermal switch device for automatically opening a circuit when the ambient temperature is increased to a predetermined level. A pair of conductor wires arranged in side by side fashion are spring loaded into contact with one another by inserting the contact regions into a cup-shaped pellet of heat-fusible material. The cup is structurally secured within a nonconductive tubular casing with a layer of insulative cement. The lead regions of the wires are also securely anchored within the casing with an insulative cement.

12 Claims, 13 Drawing Figures

THERMAL SWITCH AND METHOD OF MAKING

BACKGROUND OF THE INVENTION

The invention relates generally to an unresettable switch which will open a circuit when the ambient temperature around the circuit is increased to a predetermined level.

Switches of the type generally described have become necessary to protect various circuitry in devices, such as appliances, etc., from the hazards of high temperatures generated therein. Prior art devices of the type generally described are typically multipiece units relying upon a conductive casing to carry current in the circuit from one lead to the other within the switch. Commercially available switches of this type typically utilize a large number of individual parts, for example between nine to eleven parts are used in known commercial embodiments of this type. Thus, in addition to the use of a conductive case, which will not permit x-ray quality control examination and which, conceivably, could contribute to a shorting situation within the circuitry, the number of parts required significantly contributes to the cost of such a device. Other prior art attempts to obtain a thermal switch device of the type described involve the dipping of the switch extremities of a pair of spring lead wires with a heat-fusible material and thereafter conformally encasing the portion of the leads and totally conformally coating the heat-fusible material with an insulative structure. While this type of device, and the type first described above, do provide a satisfactory component, there appears to be certain inherent production difficulties, such as the difficulty of controlling the volume of the dip, the time for the dip, etc., that must be overcome in order to manufacture the devices in an efficient production basis.

SUMMARY OF THE INVENTION

It is a primary object of this invention to provide an efficiently manufactured thermal switch device which minimizes the number of parts utilized while maximizing the structural rigidity of the switch when finally assembled.

In keeping with the primary object of the invention, it is a further object of the invention to provide a thermal switch device which incorporates the loaded spring energy designed to break the contacts within the lead wires themselves.

A still further and more specific object of the invention is to utilize a heat-fusible pellet configured to surround the contact regions of the conductor wires in a manner which reliably maintains the contacts in forceful engagement with one another until the pellet loses its structural integrity upon the attainment of a predetermined ambient temperature level.

A particular advantage of the present invention resides in the formation of a flat bimetallic conductor wire as lead, contact and spring in a single wire in such a manner as to increase the contact force and contact opening spring energy as the temperature increases. This contributes to a substantially instantaneous contact opening and thus aids in the elimination of arcing during the opening of the contact.

These and other objects of the invention are basically provided by a structure which utilizes a tubular outer casing of an insulative, preferably ceramic, material. A cup-shaped heat-fusible pellet is inserted into and embedded in an insulative ceramic content at one extremity of the casing. The inner diameter of the casing and outer diameter of the pellet will be such as to permit a slight annular gap between the tube and pellet. The compression of the cement causes a thin layer of the cement to extrude upwardly into the annular gap and which when hardened structurally supports the pellet within the casing. A pair of lead wires are formed to provide a primary spring force, tending to disassociate the contacts, and a secondary spring force, tending to load the contacts together with a resilient force when they are inserted into the pellet. The primary spring force is loaded by forcing the lead regions of the contact wires toward one another and retaining them in insulative, anchored arrangement relative to one another by the use of a washer and a volume of insulative cement.

DESCRIPTION OF THE PREFERRED EMBODIMENTS

Figure 1:
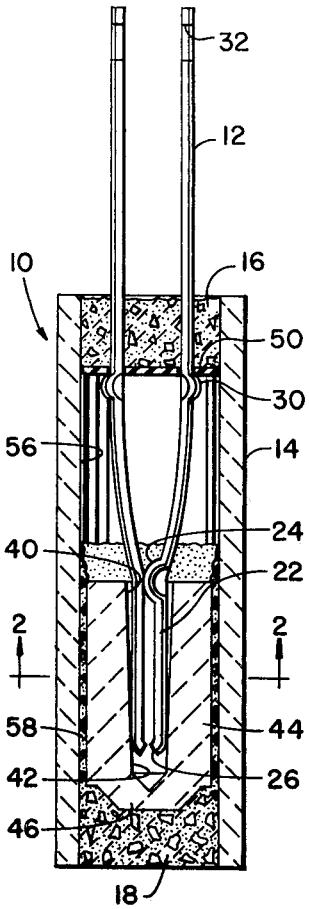
FIG. 1 is a central, longitudinal, cross-sectional view of the thermal switch device of the invention.
Figure 3:
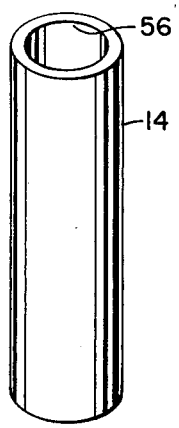
FIG. 3 is a perspective view of the tubular outer casing used in manufacturing the switch of the invention.

The thermal switch device 10 of the invention will be described generally with reference to FIG. 1 and then with reference to the various steps in manufacturng the switch in FIGS. 4, 5, 7, 11 and 13.

The external appearance and configuration of the device 10 includes a pair of relatively flat opposing contact lead wires 12 extending from one extremity of a tubular ceramic-type casing 14. The ceramic casing is preferably of a pressed material, such as steatite, which provides sufficient strength for a device of this type. Both ends of the tubular casing will include a filling of an insulative cement with a top layer 16 anchoring and insulatively locking the leads 12 and a bottom layer 18 located at the other extremity of the casing and locking a heat-fusible pellet in position.

Figure 4:
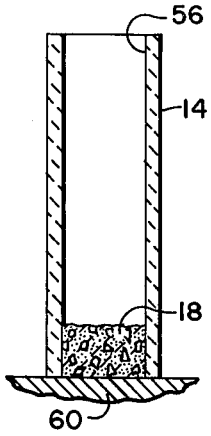
FIG. 4 is a longitudinal cross-sectional view showing a first stage in the manufacture of the switch device.
Figure 5:
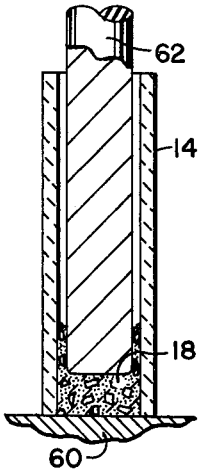
FIG. 5 is a longitudinal cross-sectional view showing a second stage in the manufacture of the switch device.

As shown in FIG. 4, a first step in the manufacture of a device of this type involves the positioning of the casing 14 on a support surface 60 and inserting a certain, predetermined volume, of an insulative cement 18 at the supported extremity of the tube. In practice, it has been found that a chemical setting, ceramic-type cement as produced by Sauerisen Cements Company produces the desired results. However, it should be understood that the invention is not limited to this particular type of cement but is merely illustrative of a ceramic cement that is available for the construction of the invention. The unset and still compressible cement layer 18 is preferably precompressed and preformed with a rod-like tool 62, as shown in FIG. 5. The tool should be dimensioned so as to be slightly less than the inner diameter of the casing to permit a slight extrusion upwardly of the compressed cement. The compression accomplishes a plurality of purposes. It first tends to drive out the excess water in the compound and also preforms the layer required between the casing and the pellet.

Figure 7:
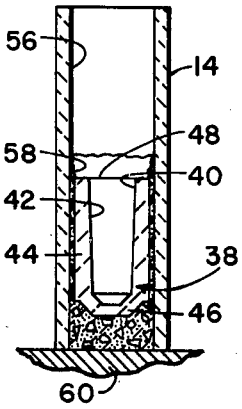
FIG. 7 is a longitudinal cross-sectional view showing a third stage in the manufacture of the device by the insertion of the pellet within the casing.

Following the precompression of the cement, the heat-fusible, cup-shaped pellet 38 is inserted into the casing and is used as a further compression and extrusion of the cement 18, as represented in FIG. 7. This could be accomplished by forcing the cup by a tool (not shown) similar to 62 against the upper face 48 of the cup. A firm controlled compression of the cement in this fashion insures that there are no voids or weak regions in the cement and permits a dense layer 58 of cement between the outer wall 44 of the pellet and the inner wall 56 of the tube as well as anchoring the base 46 of the pellet in the cement.

Figure 8:
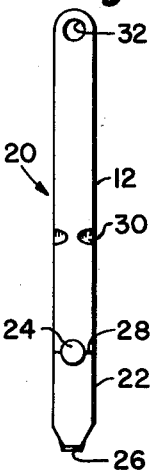
FIGS. 8 and 9 are, respectively, front and side elevational views of one contact wire used in the invention.
Figure 9:
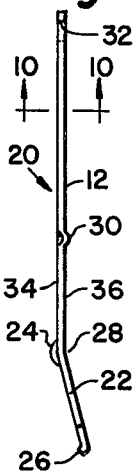
Figure 2:
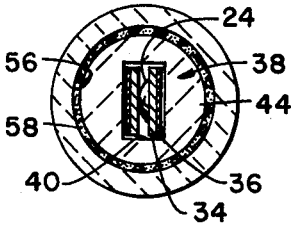
FIG. 2 is a transverse cross-sectional view as taken along lines 2—2 of FIG. 1.
Figure 11:
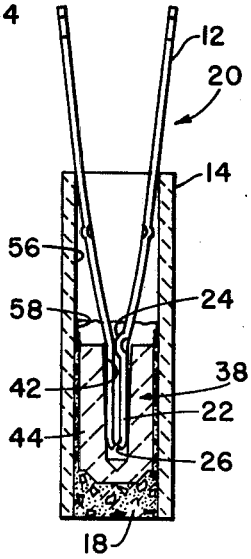
FIG. 11 is a longitudinal cross-sectional view of a fourth stage in the manufacture of the device showing the arrangement of a pair of opposed contact wires into aggressive electrical contact with one another by insertion into the pellet.
Figure 12:
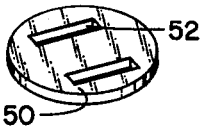
FIG. 12 is a perspective view of a loading, locating and sealing washer used in the invention.

After the cement has set and supportingly anchors the pellet, a pair of flat contact wires, such as that shown in FIGS. 8 and 9, are inserted in opposed and contacting arrangement into the bore 40 of the pellet. This step is shown in FIG. 11. It should be recognized that the spacing between the opposed wall surfaces 42 of the bore are sufficient to engage the lower extremities 26 of each of the contact wires 20. This engagement is important, as will be pointed out later herein, to provide the continuous resilient contact force at the contact point 24.

Figure 13:
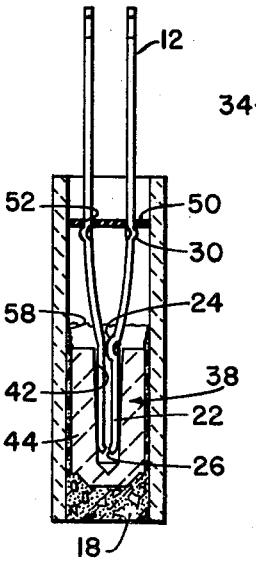
FIG. 13 is a fifth stage of manufacture of the invention showing the insertion of the washer into the casing and loading the contact wires.

The loading of the wires 20 to a condition in which energy is stored to open the circuit at a predetermined temperature is accomplished by the insertion of a flat, wafer-like washer 50 into the casing so that the lead portions 12 are received in a pair of conformally configured apertures 52. The washer is preferably of a mica material which is a superior insulative material as well as a material capable of bonding to ceramic cement. Since the leads are biased to the position shown in FIG. 11, the movement of the leads toward one another by the insertion of the washer 50 as shown in FIG. 13, effectively loads each of the wires 20 with spring energy tending to force the lead portions 22 away from one another. The spring regions are maintained in electrical contact by the heat fusible pellet 38 until the attainment of the predetermined temperature.

The final step in the manufacture of such a device involves the filling of the uppermost region of the casing with an electrically nonconductive cement layer 16 substantially identical to the layer 18. This cement electrically, insulatively anchors the leads from one another and further contributes to the sealing of the internal regions of the device 10. The final manufacturing step is essentially represented by FIG. 1.

An important feature of the invention is the incorporation of several functional features in a single, flat contact wire 20. For example, coined protuberance regions 30 adjacent the lead portion 12 accurately and fixedly position the wafer 50 for the eventual filling of cement around a substantial length of what may be characterized as anchoring portions of the lead portions. It is at this region that a cantilever spring loaded hinge is created serving to store the energy which accomplishes the opening of the switch at a predetermined temperature. With further reference to FIGS. 8 and 9, additional significant features of the wire 20 will become apparent. While only one such wire is shown, it should be understood that the opposing wire may be identical in all respects. However, it may be preferred that only one wire have a protrusion 24 serving as a point contact against a flat region on the opposing wire. The contact point 24 is preferably at or near the juncture of bend line 28, creating a lever arm extending out of the plane of the remainder of the wire 20 and defined herein as the contact region 22. In operation, the opposing contact regions 22 diverge away from one another when the contact region 24 is in electrical contact with its opposing contact region. This provides a fulcrum about which the contact is made and as a result a continuous, resilient preloading force is applied at the contact region due to the engagement of the extremity 26 with the wall 42 of the cup-shaped, heat-fusible pellet 38. Holes 32 near the extremity of the lead 12 may facilitate the attachment of the device to a circuit.

Figure 10:
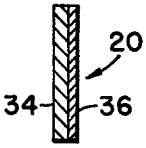
FIG. 10 is an enlarged cross-sectional view of the contact wire as taken along lines 10—10 in FIG. 9.

It is important to note from FIG. 10 that the preferred embodiment of the wire 20 is a bimetallic composite conductive wire. The innermost or contacting regions 34 are of a material with a high linear coefficient of thermal expansions, such as copper, and the outermost region 36 will be of a relatively low coefficient of thermal expansion but of high spring capabilities, such as stainless steel. The use of such a bimetallic wire in a switch which is retained in electrical contact condition solely by a heat-fusible element produces a significant advantageous result. As the heat increases toward a predetermined maximum temperature level, the innermost surfaces of the opposing conductor wires 20 will tend to expand at a greater rate than the outermost surfaces. In a thermal switch of the type described by this invention, such differential expansion serves to increase the primary contact opening spring energy loaded in the region of the locating protuberances 30 and perhaps, more importantly, increases the secondary preloaded spring force existing at opposing contact points 24. Thus, when the predetermined circuit opening temperature is approached, the contact force is maximized, thus overcoming any deleterious effects of arcing or cold flow of the wires into the heat-fusible pellet.

A further significant feature of the design of the conductor wires 20 is shown in the configuration of the extremity 26 of each of the contact regions 22. The extreme end of the contact regions is rounded by deforming the tip inwardly in a direction toward the opposing surface region about a line extending transverse the longitudinal axis of the wire. Such a tip configuration distributes the contact force over a line of engagement with the inner wall of the pellet which minimizes the cold flow of the pellet responsive to the force exerted by the wire. The rounding of the tip also eliminates scouring or scraping of the wall 42 of the pellet as the contacts are inserted into the pellet.

Figure 6:
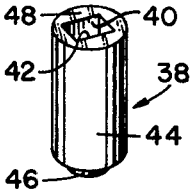
FIG. 6 is a perspective view of a heat-fusible, cup-shaped pellet used in the invention.

As shown in FIGS. 1 and 6, the pellet 38 is basically configured as a cup with a centrally located blind bore 40 formed therein. The bore is preferably rectangular in shape having side walls 42, generally the width of the wire 20. The bore will taper upwardly and outwardly so that the thickness of the side wall of the pellet near the bottom wall 46 is greater than the thickness of the side wall of the pellet adjacent the upper surface 48. Such a tapered bore insures that the wires will contact the wall of the bore where the compressive and tensile strength of the pellet is greatest. Maximization of the strength of a cup-shaped pellet of this type occurs near the bottom wall as a result of the manufacturing technique of compressing while forming the pellet. The bottom wall may advantageously be configured as a compound surface with a flat or blunt leading surface and a tapered intermediate side surface. This may improve the strength of the compressed pellet as well as enhance the extrusion of the cement 18 between the inner wall 56 of the casing and the outer peripheral surface 44 of the pellet.

When the cement 18 is firmly compressed and extruded as in the manufacturing step of FIGS. 5 and 7 so as to supportingly engage the pellet's outer periphery and the inner wall 56 of the casing, the switch will have the structural integrity enabling it to resist certain static and dynamic forces which the device must accept and absorb without breaking or prematurely weakening the circuit formed in the device. Typical of the forces that must be accepted and absorbed are those that occur during lead attachment, and vibrations, such as would occur in shipping, handling or use of the part. With a structurally secure and supported pellet, the chances of breaking or inaccurate flowing of the heat-fusible material is minimized.

Suitable organic compounds can be carefully constituted to flow at the precise temperature level desired. While the organic material comprising the pellet 38 is intended to be nonconducting, a certain small amount of conductivity may be found during isolated conditions. For this purpose, it may be advisable to coat all regions of the conductor wire 20 below the washer, except the contact regions 24, with a thin layer of silicon. This isolates the conductivity at the contact points and serves to minimize the possibility of a conductive path being formed between any other regions of the wires 20.

Thus, it is apparent that there has been provided in accordance with the invention a thermal switch device that fully satisfies the objects, aims, and advantages set forth above. While the invention has been described in conjunction with the specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A thermal switch device comprising a pair of conductive wire members each including a switch region and a lead region at opposing extremities thereof, the switch regions arranged to generally oppose each other and including localized contact points electrically interconnecting one wire member to the other, a preformed, substantially nonconductive heat-fusible pellet arranged in surrounding engagement with at least a part of the switch region, a first spring means formed in one of said switch regions reacting against an inner peripheral surface of the heat-fusible pellet resiliently forcing the localized contact points together, a second spring means formed in at least one of said wire members intermediate the lead and switch region thereof providing stored energy biasing the switch regions away from each other when they are held in contact by the heat-fusible pellet, a tubular casing of electrically insulating material surrounding the heat fusible pellet and at least the switch regions of the conductive wire members, the outer periphery of the heat-fusible pellet rigidly, circumferentially supported by the inner periphery of the casing, both extremities of the casing being sealed, the lead regions of each wire member extending outwardly from the casing and including an anchoring portion fixedly secured within an extremity of the casing with an insulative cement so as to load the second spring means and electrically insulate the anchoring portions of the conductive wire members from each other.

2. The thermal switch device of claim 1, wherein the lead regions of both conductive wire members extend in the same direction outwardly from the same extremity of the casing, the heat-fusible pellet being generally cup-shaped including a blind bore into which the switch regions of each conductive wire member are received and supported.

3. The thermal switch device of claim 1, wherein a conformal layer of insulative cement is interposed between the inner wall of the casing and the outer periphery of the pellet fixedly supporting the pellet within the casing.

4. The thermal switch device of claim 2, wherein the extremity of the casing adjacent the cup-shaped pellet is filled with insulative cement coating the bottom wall and the outer peripheral surfaces of the cup and thereby fixedly supporting the cup relative to the inner wall of the casing.

5. The thermal switch device of claim 2, wherein the first spring means consists of a lever arm formed at the extremity of one of the switch regions with a fulcrum region spaced from the free extremity of the lever arm creating the localized contact point which is resiliently compressed against the opposing switch region by an associated wall of the blind bore in the pellet.

6. The thermal switch device of claim 5, wherein the blind bore of the pellet is tapered to provide a smaller transverse dimension adjacent the bottom surface of the bore than adjacent the top region of the bore to insure that the switch is loaded against the region adjacent the bottom wall of the pellet where the strength of the pellet is maximized.

7. The thermal switch device of claim 2, wherein the free extremities of each of the switch regions are rounded by deforming the tip inwardly toward the opposing switch region about a line extending transverse the longitudinal axis of the wire to insure line contact between the wire and the reacting wall of the blind bore of the pellet.

8. The thermal switch device of claim 1, wherein the pair of conductive members are flat wire bimetallic devices with the inner, contacting surfaces, of the wire being of a metal which has a greater coefficient of linear thermal expansion than the metal of the outer surface, with the metal of the outer surface having high spring characteristics wherein the contact force is increased as the temperature sensed by the device is increased until a predetermined triggering temperature is reached.

9. The thermal switch device of claim 8, wherein the metal of the inner contacting surface is copper and the metal of the outer, noncontacting surface is stainless steel.

10. A method of making a thermal switch device including the steps of filling one extremity of an insulative tubular casing with a volume of insulating cement in a nonhardened condition, inserting a cup-shaped, heat-fusible pellet of insulating material into the casing, the maximum transverse dimension of the pellet being less than the inner diameter of the casing compressing the unhardened cement with the base of the pellet and forcing a portion of the cement upwardly into supporting contact with the outer periphery of the pellet and the associated inner wall portion of the casing so that the pellet is supportingly secured by the cement within the casing, inserting the free extremities of a pair of spring contact wires into the bore of the cup-shaped heat-fusible pellet thus bringing the contact point of each wire into aggressive resilient contact with each other as a result of the interaction between the walls of the bore and the spring contact wires, locking regions of the wires spaced upwardly from their contact points in fixed insulative position relative to each other and to the tubular casing to load the wires with cantilever spring energy causing the circuit thus formed to break when the ambient heat increased to a certain predetermined level which flows the heat-fusible pellet releasing the stored cantilever spring energy.

11. The method of claim 10, wherein the volume of insulating cement is preformed and precompressed before the insertion of the pellet into the casing.

12. The method of claim 10, including the steps of positioning an insulating washer device about the upper region of the wires, causing the spring loading of the wires, and filling the upper region of the casing, above the washer, with insulative cement to lock the wires within the casing.

* * * * *